US006225939B1

(12) United States Patent
Lind

(10) Patent No.: US 6,225,939 B1
(45) Date of Patent: May 1, 2001

(54) IMPEDANCE SHEET DEVICE

(75) Inventor: Arthur C. Lind, Chesterfield, MO (US)

(73) Assignee: McDonnell Douglas Corporation, Seattle, WA (US)

( * ) Notice: Subject to any disclaimer, the term of this patent is extended or adjusted under 35 U.S.C. 154(b) by 0 days.

(21) Appl. No.: 09/235,848

(22) Filed: Jan. 22, 1999

(51) Int. Cl.[7] ..... H01Q 17/00
(52) U.S. Cl. ..... 342/4; 342/1
(58) Field of Search ..... 342/1, 2, 3, 4, 342/5, 6, 7, 8, 9, 10, 11

(56) References Cited

U.S. PATENT DOCUMENTS

| | | | | |
|---|---|---|---|---|
| 2,951,247 | | 8/1960 | Halpern et al. . | |
| 3,152,328 | | 10/1964 | McMillan . | |
| 3,887,920 | | 6/1975 | Wright et al. . | |
| 4,118,704 | | 10/1978 | Ishino et al. . | |
| 4,162,496 | | 7/1979 | Dowen | 342/4 |
| 4,495,503 | | 1/1985 | Morman . | |
| 4,972,191 | * | 11/1990 | Ishino et al. | 342/1 |
| 4,996,097 | | 2/1991 | Fischer . | |
| 5,047,296 | * | 9/1991 | Miltenberger et al. | 342/1 X |
| 5,085,931 | | 2/1992 | Boyer, III et al. . | |
| 5,110,651 | | 5/1992 | Massard et al. . | |
| 5,214,432 | | 5/1993 | Kasevich et al. | 342/3 |
| 5,225,454 | | 7/1993 | Lofgren . | |
| 5,275,880 | | 1/1994 | Boyer, III et al. . | |
| 5,325,094 | | 6/1994 | Broderick et al. | 342/1 |
| 5,457,598 | | 10/1995 | Radford et al. . | |
| 5,537,116 | | 7/1996 | Ishino et al. | 342/1 |
| 5,543,796 | | 8/1996 | Thomas et al. | 342/4 |
| 5,576,710 | | 11/1996 | Broderick et al. | 342/1 |
| 5,627,541 | | 5/1997 | Haley et al. | 342/1 |
| 5,635,293 | | 6/1997 | Korleski et al. . | |

* cited by examiner

*Primary Examiner*—Bernarr E. Gregory
(74) *Attorney, Agent, or Firm*—Bryan Cave LLP

(57) ABSTRACT

A thin sheet impedance device and process for controlling the resistance, capacitance and inductive properties of a material through the use of a plurality of impedance elements of specific sizes, shapes and material on one side of a thin dielectric sheet in combination with a plurality of similar impedance elements and/or a layer of resistive material on the opposite side of the dielectric sheet.

10 Claims, 11 Drawing Sheets

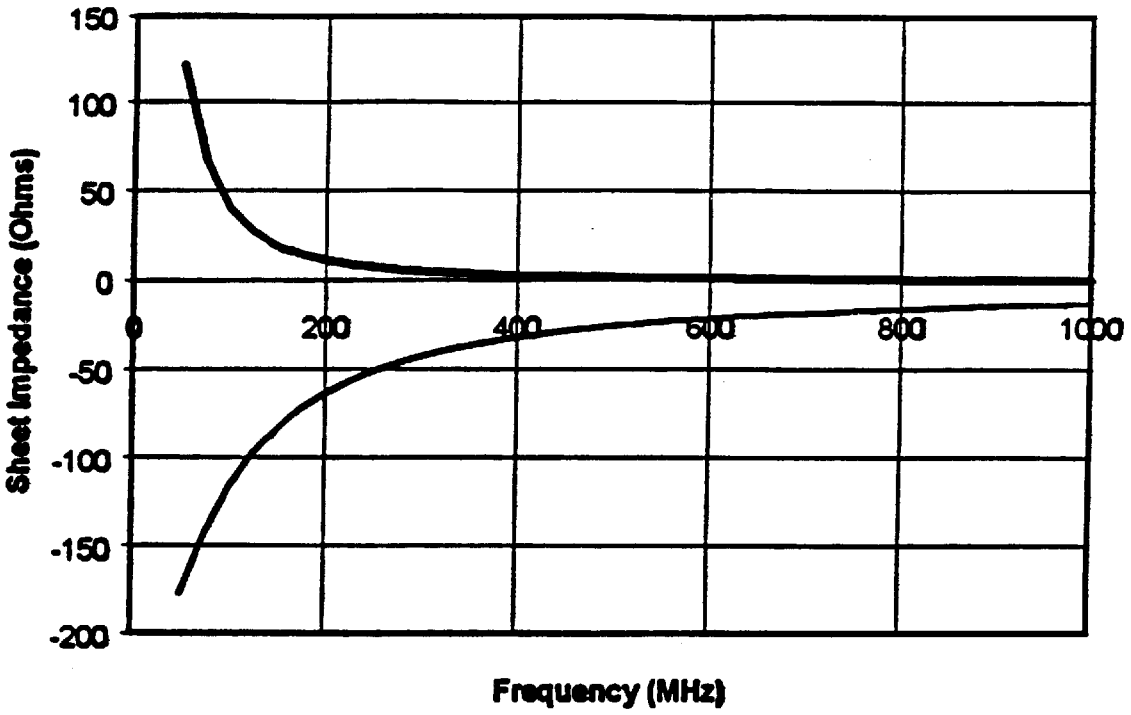
FIG. 9
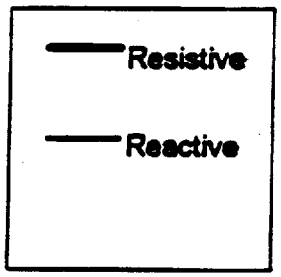

IMPEDANCE SHEET DEVICE

BACKGROUND OF THE INVENTION

1. Field of the Invention

The present invention relates generally to a device which provides controllable levels of complex impedance and more particularly to a layered material with complex impedance properties for controlled transmission, reflection and/or absorption of selective frequencies of electromagnetic radiation.

2. Description of the Prior Art

Conventional structures utilized in the control of transmission, reflection and absorption of electromagnetic radiation typically incorporate one or more impedance devices to obtain the desired electromagnetic wave manipulation characteristics. The required impedance properties are generally characterized in terms of their resistive, inductive and capacitive components. These prior art impedance devices are typically fabricated in a sheet form and may comprise a layer of conductive or resistive material to obtain the desired impedance properties. One approach to achieve the desired level of impedance comprises the use of arrays or patterns of impedance elements which are formed from conductive or resistive materials on one surface of a layer of electrically insulating supporting material. The elements are typically formed by deposition of or by removing geometric sections from an electrically conductive or resistive film applied to the supporting material layer. The required capacitance of the impedance sheet may be controlled by varying the size and shape of the impedance elements, and by varying the spacing between the impedance elements in the array.

However, for applications requiring relatively higher capacitance values, typically sheet capacitance values on the order of 100 pico-Farads per square, this approach necessitates impedance elements of substantial proportions, leading to undesirable performance characteristics, including unacceptable levels of electromagnetic wave reflection. Also, when a composite structure is constructed from a plurality of impedance sheets incorporating such larger impedance elements which are spaced and separated by layers of dielectric material, the secondary capacitive effect created by the interaction between successive layers of impedance sheets in relative proximity can induce unforeseen and undesirable results in the electromagnetic wave manipulation properties of the structure.

One method which attempts to achieve greater capacitance while minimizing the secondary capacitive effect is the use of successive layers of conventional impedance sheets to form a thin composite device with multiple layers of impedance elements in relative proximity. This configuration induces a capacitive effect between proximate impedance elements in adjacent layers. By selecting appropriate sizes and shapes of the impedance elements, desired capacitance values can be achieved.

However, this approach also has serious limitations due to the inherent difficulty in maintaining the alignment between the elements in the successive layers. Minor misalignment of the impedance elements in successive layers can produce substantial localized variations in the capacitance properties of the sheet. Additionally, the cumulative effect of manufacturing tolerances over extended segments of the combined layers exacerbates the extent of impedance element misalignment and the resulting fluctuation of capacitance values. Further, large capacitance values can only be achieved by using layers of three or more impedance sheets, thereby increasing the thickness, weight and cost of the material, as well as increasing the potential for misalignment between successive layers within the combination configuration.

The general use of such geometrically shaped elements comprising an impedance layer of an electromagnetic radiation attenuation structure in the prior art is disclosed, by way of example, in U.S. Pat. Nos. 5,627,541; 5,576,710; 5,325,094; 5,214,432; 3,887,920; and 3,152,328. U.S. Pat. No. 5,627,541 uses an array of elongated, narrow conductive areas arranged in uniformly spaced columns and rows. U.S. Pat. No. 5,576,710 uses a series of conductive dipoles arranged in a semi-random or comparable pattern, preferably a series of square patches of particular dimensions separated by gaps of particular widths. U.S. Pat. No. 5,325,094 uses a resistive sheet formed into a broken pattern that may comprise a series of geometric shapes spaced apart from one other. U.S. Pat. No. 5,214,432 uses resistively loaded impedance elements that are disposed in a random and preferably a periodic pattern. U.S. Pat. No. 3,887,920 uses uniform geometric figures, including a thin film array of closely-packed aluminum squares. U.S. Pat. No. 3,152,328 uses layers of concentric printed disks of electrical energy absorbing material with incrementally reduced diameters, arranged in superposition to form a plurality of cone-shaped absorbing bodies.

The present invention eliminates or substantially reduces the disadvantages of the prior art through the use of conductive, resistive and/or inductive impedance elements on both sides of the dielectric sheet, rather than limiting their use to only one side. This configuration enables substantially larger values of capacitance to be attained in a single layer device, because relatively thin dielectric sheets can be used. Also capacitance can be precisely controlled. By varying the size, shape and composition of the impedance elements and by combining with resistive sheets, the desired combination of resistance, capacitance and inductive properties can be achieved to produce a tailored frequency-dependent electromagnetic wave reflection response.

SUMMARY OF THE INVENTION

The present invention is a complex impedance sheet and a method for providing such impedance which provides precise levels of complex impedance in a layered material to control the transmission, reflection and/or absorption of selected frequencies of electromagnetic radiation incident to the material. The present invention comprises a thin sheet of a dielectric material having electrically conducting or resistive impedance elements on one side in combination with similar impedance elements and/or a resistive layer on the opposite side. Three primary types of configurations are described.

The first type of configuration has impedance elements on both sides of the dielectric sheet, which preferably are offset from one another. This offset arrangement allows relatively large capacitances to be obtained. The second type of configuration has impedance elements on the first side of the dielectric sheet, and a uniform coating of resistive material on the second side. The third configuration type also has elements on both sides of the dielectric sheet, which preferably are offset from one another, in planar contact with the first side of another dielectric sheet, the second side of which is uniformly coated with a resistive material.

In all three configuration types, the impedance elements can be shaped to provide the required resistance and/or the inductance properties. Anisotropic or isotropic impedance characteristics (with respect to the major and minor axes of the plane of the impedance sheet) can be attained by varying the element dimensions and/or the spacing between elements with respect to these axes.

The present invention preferably further comprises a method for controlling the resistance, capacitance and inductive properties of a material through the use of a plurality of impedance elements of specific sizes, shapes and material on one side of a thin dielectric sheet in combination with a plurality of similar impedance elements and/or a layer of resistive material on the opposite side.

One particular application of the invention is for use in electromagnetic radiation attenuation structures. A variety of such attenuation structures comprise multiple layers of resistive material or arrays of conductive or resistive elements spaced between dielectric layers. The impedance for the circuit analog of each layer dictates the electromagnetic radiation absorption frequency range. The present invention is particularly well suited for the impedance layers in this application in that it offers a broad range of high tolerance impedance properties in a thin layer design with minimal interaction between layers.

The present invention preferably further comprises a structure for attenuation of the electromagnetic radiation within desired frequency ranges through the use of a plurality of thin dielectric sheets, each having impedance elements of specific sizes, shapes and material on one side of the sheet in combination with a plurality of similar impedance elements and/or a layer of resistive material on the opposite side, and each sheet supported by layers of dielectric material at fixed distances in front of an electrically conductive reflector. The distances between the electrically conductive reflector and the impedance sheet devices are selected such that attenuation of the electromagnetic radiation within desired frequency ranges results.

This invention can also be used in other applications where high capacitance, high tolerance impedance sheet devices are required, such as in electromagnetic wave transmission antenna applications.

Further advantages of the present invention will be recognized by those skilled in the art.

BRIEF DESCRIPTION OF THE DRAWINGS

To facilitate further description of the invention, the following drawings are provided in which:

FIG. 9 is a graphical illustration depicting the complex impedance properties of an example of an impedance sheet device as a function of the electromagnetic radiation frequency;

These drawings are provided for illustrative purposes only and should not be used to unduly limit the scope of the invention.

DETAILED DESCRIPTION OF THE PREFERRED EMBODIMENT

The present invention preferably has a dielectric material layer having two surfaces, with a uniformly-spaced array of identical square impedance elements formed of conductive or resistive material on the first and second surfaces, wherein the impedance elements are staggered in an offset arrangement such that the center of each impedance element on one surface of the dielectric sheet is directly opposite the midpoint between adjacent pairs of impedance elements on the opposite surface of the dielectric sheet.

As an example of the capacitance values which may be attained with this invention, a sheet capacitance of about 93 pico-Farads per square was obtained by using 0.400"× 0.400" square impedance elements on both sides of a 0.00033" thick polyimide dielectric sheet having relative dielectric permittivity of 3.5.

The advantages of using the relatively smaller impedance elements to achieve the desired capacitance properties are: the scatter effect of high frequency electromagnetic radiation is minimized; the interaction between successive layers of capacitive material is minimized; and the variances in capacitance and other impedance characteristics within the sheet due to manufacturing variations is minimized when compared to conventional capacitance sheets.

Additionally, this invention accommodates a wide range of impedance element materials, sizes, shapes and spacing distances which can be tailored to meet specific application requirements for capacitance, resistance and inductance. Further, although one embodiment of the present invention incorporates impedance elements which are geometrically symmetrical and dimensionally identical with respect to both the major and minor axes to produce isotropic characteristics, in other embodiments the impedance element configuration can be varied to produce an anisotropic orientation of the resistance and reactance characteristics.

Another embodiment of the present invention demonstrates the advantage that the element sizes, configurations and spacing may also be incrementally altered along the axes of the sheets to produce a gradual transition in the resistance and reactance characteristics of the impedance sheet to meet impedance requirements which vary over different areas of the intended application.

Figure 1:
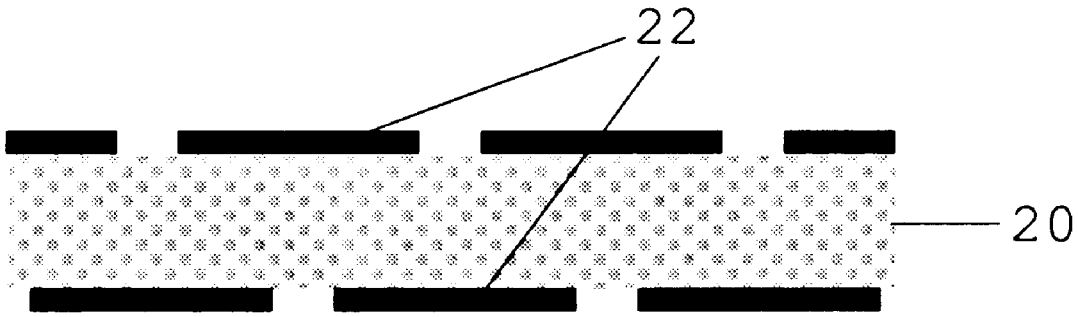
FIG. 1 is a cut-away cross-sectional view of the preferred embodiment of the present invention.

Referring now to the drawings in detail, and particularly to FIG. 1, a cutaway cross-sectional view of the presently preferred embodiment of the present invention is shown. As shown and preferred in FIG. 11, a thin dielectric layer 20 is disposed on both sides with an array of conductive or resistive geometrically shaped impedance elements 22. The dielectric layer 20 may consist of different types of dielectric materials, preferably a strong, flexible material with a controlled dielectric constant, such as polyimide, Mylar® or Kapton®, by way of example.

Figure 2:
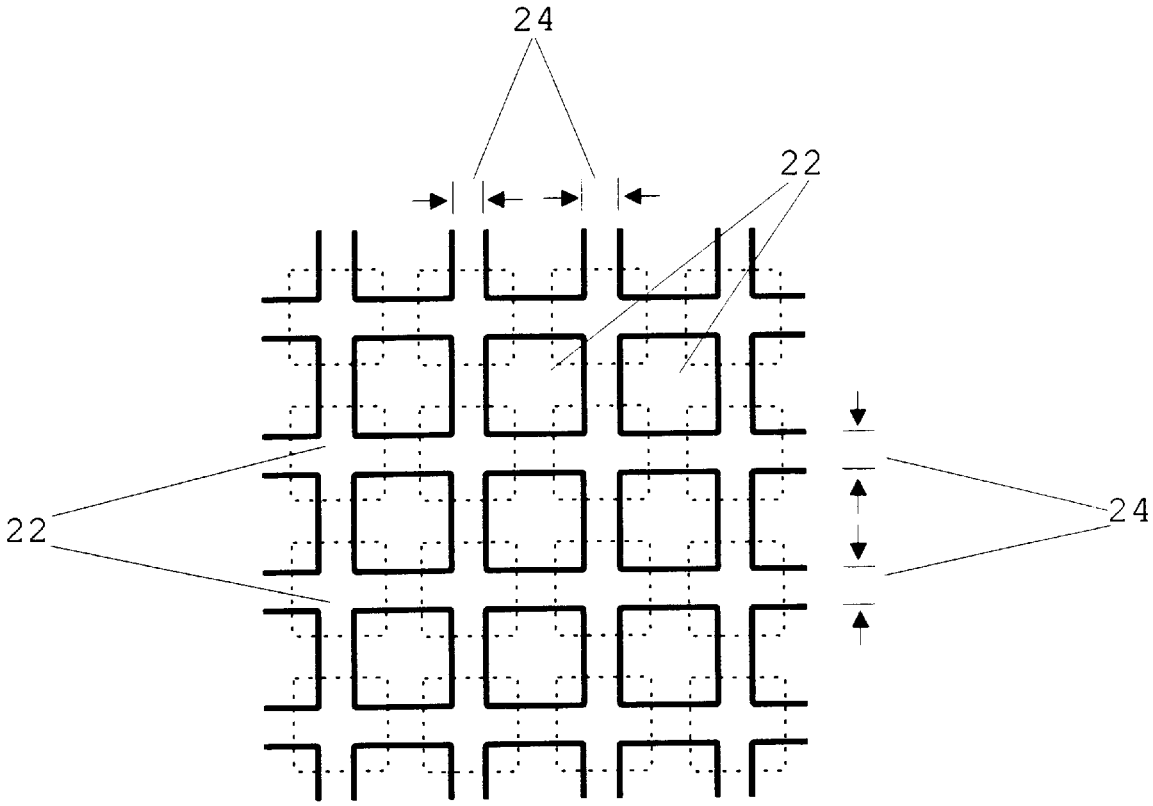
FIG. 2 is a top view depicting a 50% offset between the impedance elements on the opposite sides of the dielectric layer of the embodiment of FIG. 1.

FIG. 2 illustrates a rectangular array of impedance elements 22 in the preferred embodiment of FIG. 1. In this preferred embodiment, the size and geometric configuration of the impedance elements 22 on the opposite sides of the dielectric layer 20 are identical, specifically in a square form. Similarly, the spacing interval 24 between the impedance elements 22 on the one side along the major and minor axes of the dielectric layer is constant and is equal to the spacing interval between elements on the opposite side of the dielectric layer. Because the dimensions and spacing of the impedance elements 22 are equal along the major and minor axes, this embodiment exhibits isotropic impedance characteristics. As further shown and preferred in FIG. 2, there is a staggered offset relationship between the geometric impedance elements 22 on the opposite sides of the dielectric material 20 along both the major and minor axes. This offset feature allows large magnitudes of capacitance to be attained, and additionally provides impedance properties which are less sensitive to manufacturing variations inherent in the fabrication and orientation of the impedance elements 22.

Figure 3:
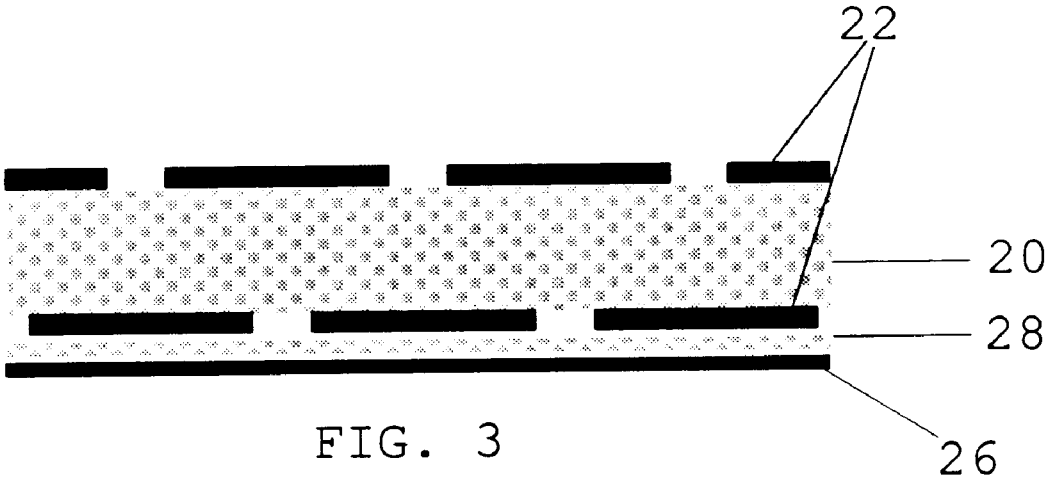
FIG. 3 is a cut-away cross-sectional view of another preferred embodiment of the present invention incorporating a resistive layer.

Referring now to FIG. 3, FIG. 3 illustrates another preferred embodiment of the present invention which incorporates a thin dielectric sheet 20 and arrays of impedance elements 22 on the opposite sides thereof, such as described in the preferred embodiment of FIGS. 1 and 2, with the addition of a thin layer of resistive material 26, supported at a fixed distance from the second side of the dielectric sheet 20 by another dielectric sheet 28. This layer of resistive material 26 enhances the levels of resistive properties which can be obtained from the impedance sheet.

Figure 4:
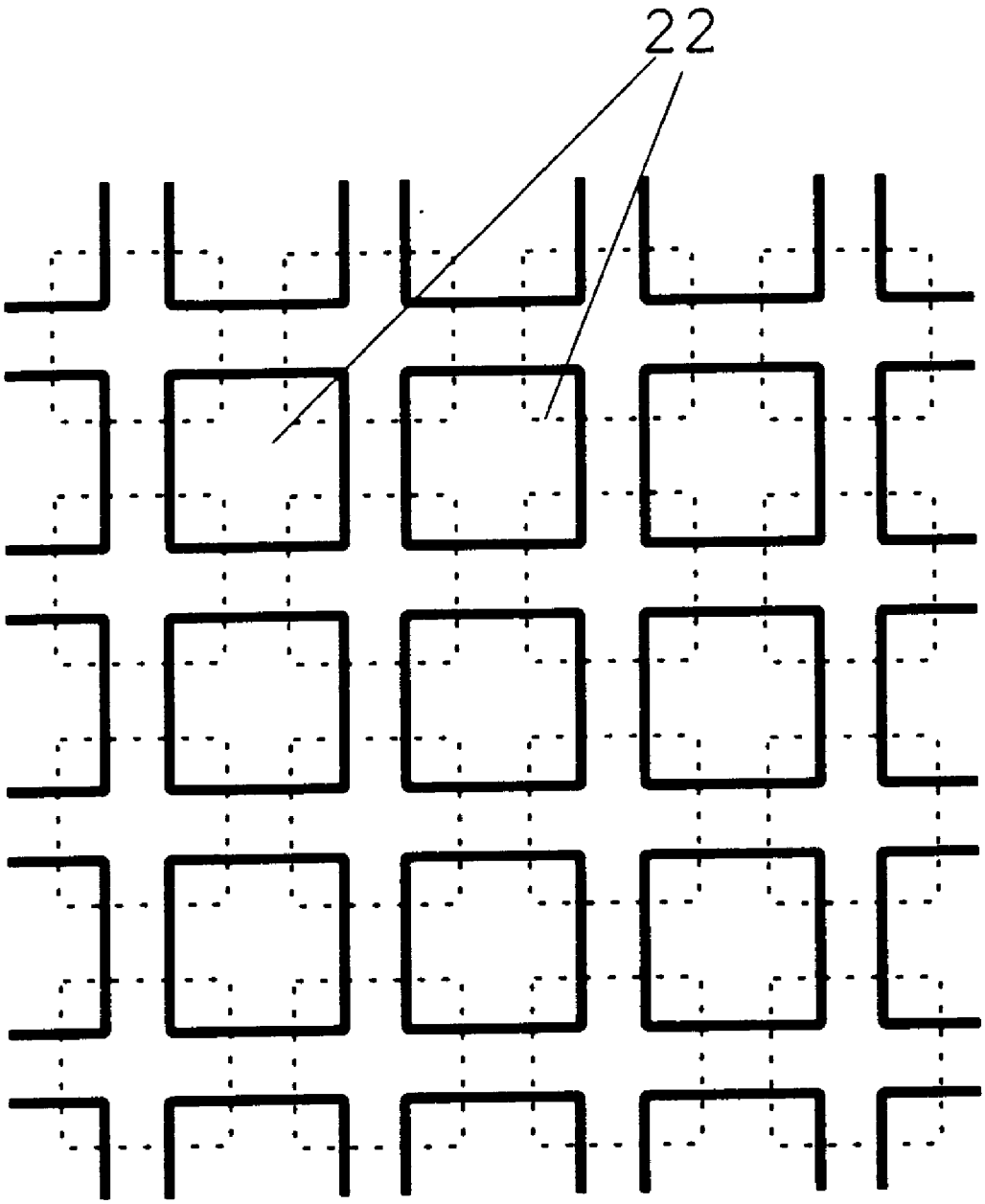
FIG. 4 is a top view depicting a 50% offset between the impedance elements on the opposite sides of the dielectric layer of the embodiment of FIG. 3.

FIG. 4 illustrates a rectangular array of impedance elements 22 in the embodiment of FIG. 3.

Figure 5:
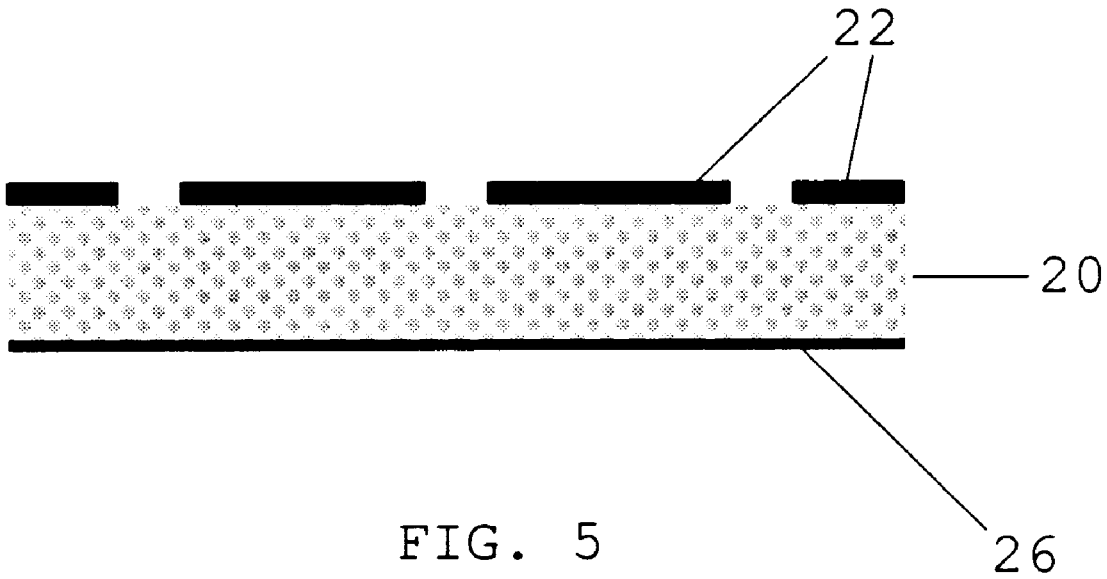
FIG. 5 is a top view of a third preferred embodiment of the present invention.

Referring now to FIG. 5, FIG. 5 illustrates another preferred embodiment of the present invention which incorporates a thin dielectric sheet 20 disposed with an array of impedance elements 22 on the first side, and a thin layer of resistive material 26 disposed on the opposite side of the dielectric sheet 20.

Figure 6:
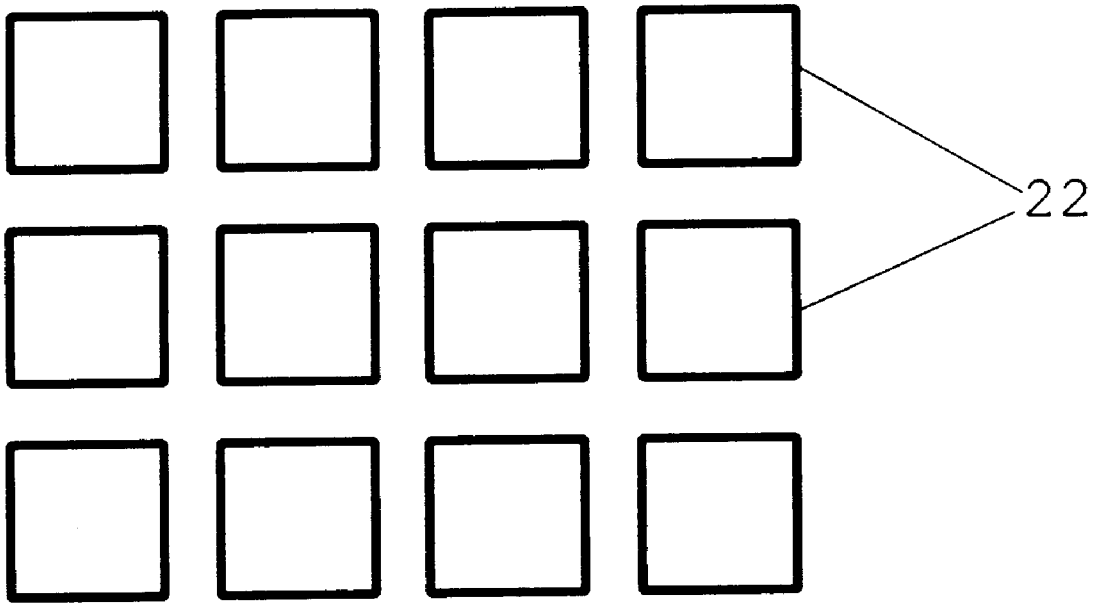
FIG. 6 is a top view depicting the arrangement of impedance elements in the embodiment of FIG. 5.

FIG. 6 illustrates a rectangular array of impedance elements 22 on the first surface of the dielectric sheet 20 in the embodiment of FIG. 5.

Figure 7:
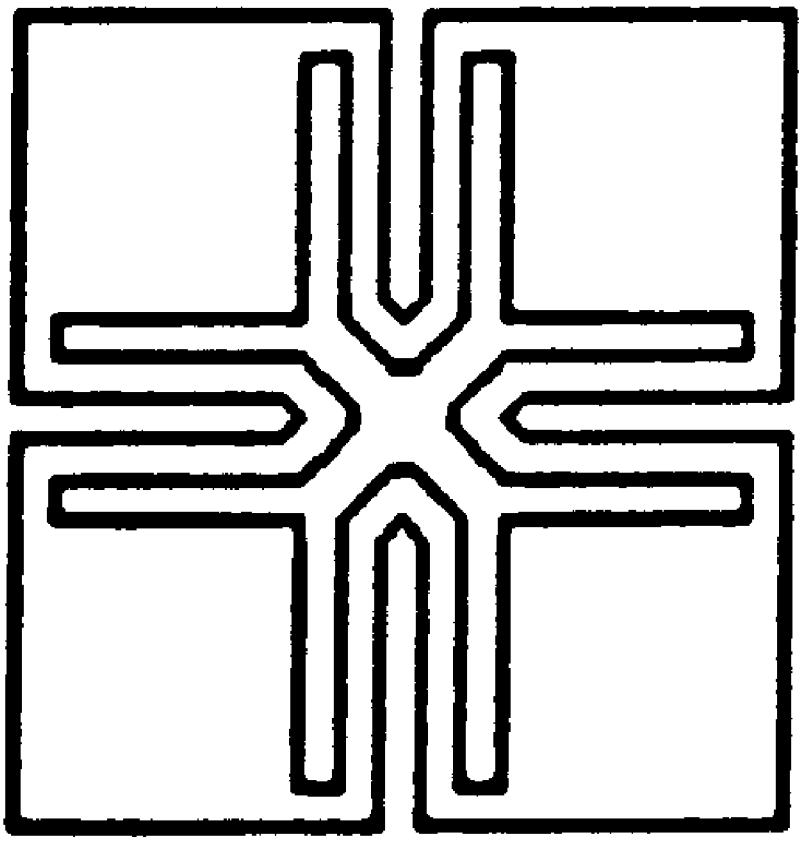
FIG. 7 is an example of an isotropic impedance element.
Figure 8:
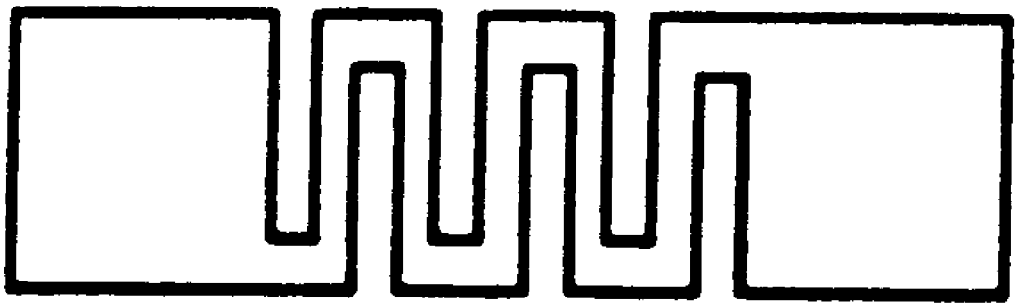
FIG. 8 is an example of an anisotropic impedance element.

FIGS. 7 and 8 depict examples of typical configurations of impedance elements in accordance with the present invention, illustrating the potential for enhancing the resistive and inductive properties of the impedance sheet. In this regard, FIG. 7 illustrates an equilateral geometric impedance element which is formed of resistive or conductive material with areas of the material removed to provide enhanced inductive and/or resistive properties to provide an impedance sheet with isotropic characteristics. Alternatively, FIG. 8 illustrates a similarly fabricated geometric impedance element with unequal dimensions in the lateral and longitudinal orientations, which provides enhanced inductive and/or resistive properties for an impedance sheet with anisotropic characteristics.

Referring now to FIG. 9, FIG. 9 graphically illustrates an example of typical resistive and reactive impedance characteristics for the impedance sheet depicted in FIG. 3 as a function of the frequency of the applied electromagnetic radiation.

Figure 10:
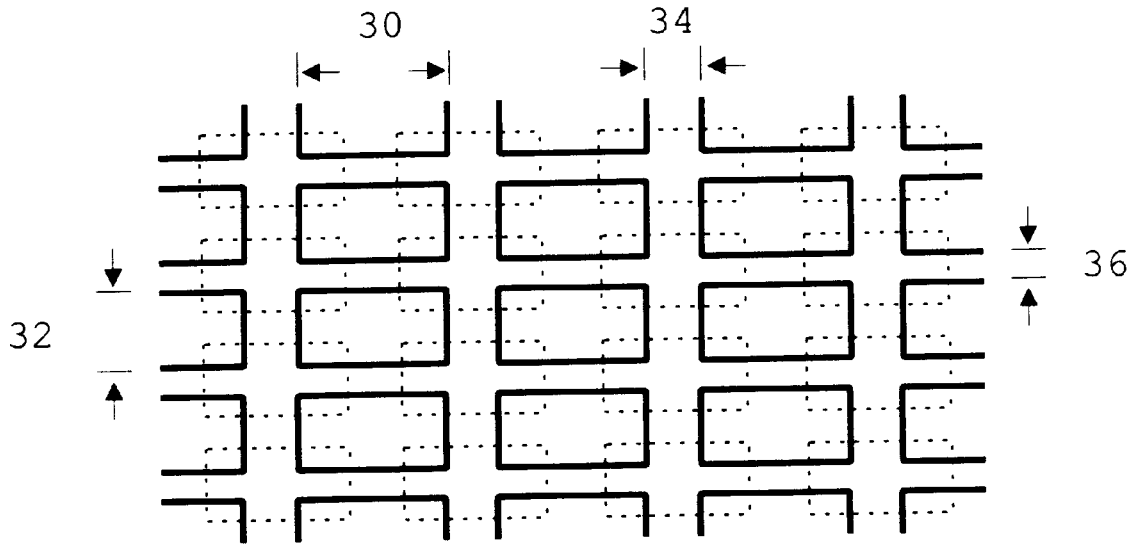
FIG. 10 is a top view of an example of an anisotropic impedance sheet configuration.

Referring now to FIG. 10, FIG. 10 illustrates an example of an anisotropic impedance sheet which comprises geometric impedance elements with unequal dimensions along the major axis 30 and the minor axis 32. Additionally, the spacing between elements along the major axis 34 may be different from the spacing between elements along the minor axis 36. As also shown and preferred in FIG. 10, there is a 50% offset between the impedance elements on the first and second sides of the dielectric layer along both the major and minor axes.

Figure 11:
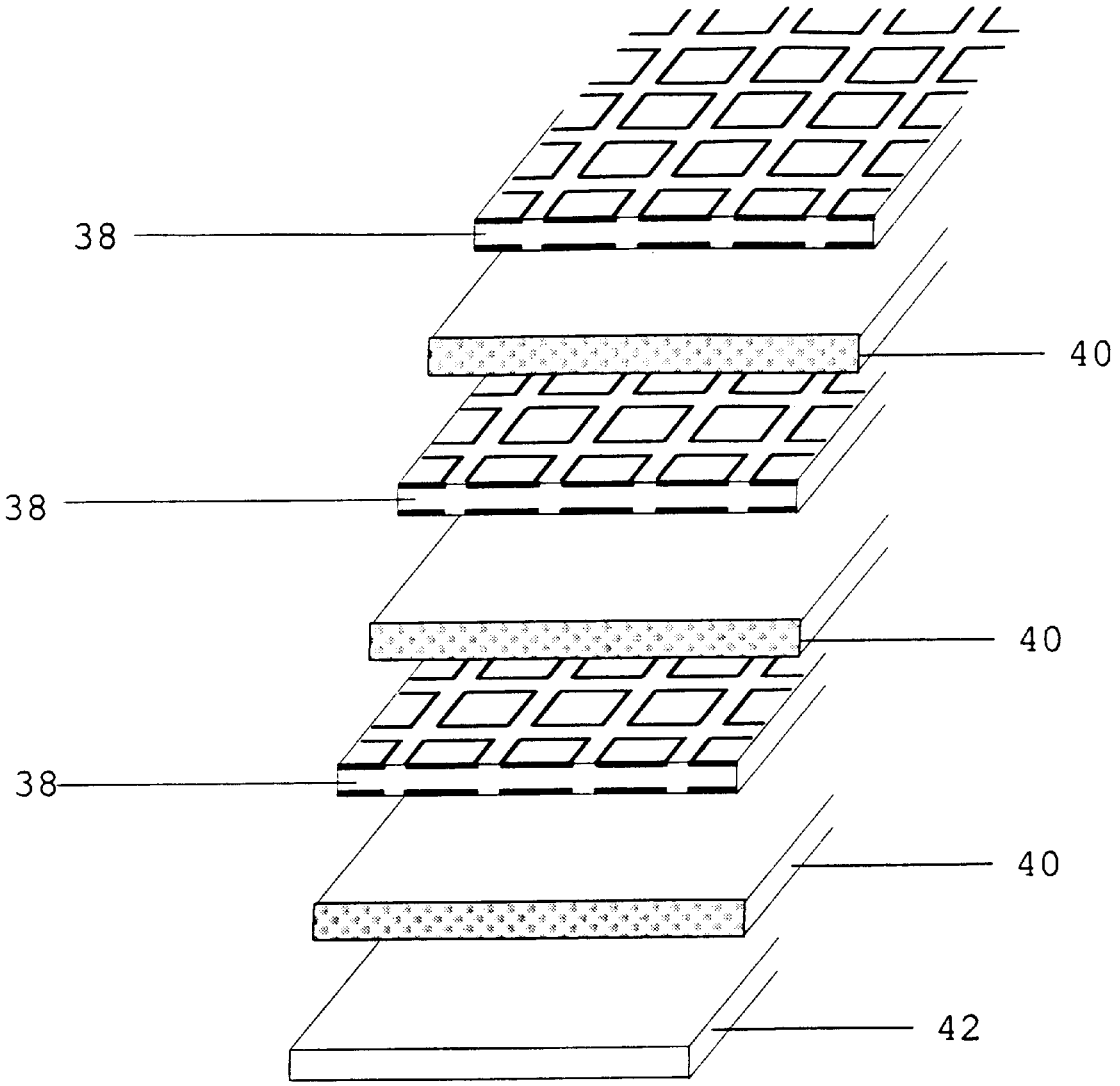
FIG. 11 depicts an example of an electromagnetic radiation attenuation structure incorporating a plurality of impedance sheet devices supported by layers of dielectric material at fixed distances in front of an electrically conductive reflector.

FIG. 11 is an exploded view illustrating a typical electromagnetic radiation attenuation apparatus using the present invention. The apparatus comprises a plurality of the previously described impedance sheets 38 separated by dielectric spacing layers 40 configured to orient the impedance sheets 38 at desired distances from a reflective conducting surface 42. In this type of preferred application, the present invention offers the advantage of reducing the required spacing between the impedance layers or sheets and the conducting surface, thereby reducing the thickness, weight and cost of the structure.

Variations and modifications of the present invention will be apparent to those skilled in the art and the claims are intended to cover any variations and modifications falling within the true spirit and scope of the invention.

What is claimed is:

1. A sheet impedance device comprising:

a dielectric sheet, having a first surface and a second surface opposite said first surface;

a first array of spatially separated, substantially planar impedance elements comprised of conductive or resistive materials disposed on said first surface of said dielectric sheet; and a second array of spatially separated, substantially planar impedance elements disposed on said second surface of said dielectric sheet: whereby impedance elements are provided on both sides of said dielectric sheet such that for each impedance element on said first surface of said dielectric sheet, the distance between a line perpendicular to the plane of the impedance element passing through the geometric center point of the impedance element and the geometric center point of the most proximate impedance element disposed on said second surface of said dielectric sheet is greater than zero.

2. A sheet impedance device in accordance with claim 1 wherein said impedance elements are positioned in a staggered arrangement such that for each impedance element on said first surface of said dielectric sheet, the line perpendicular to the plane of the impedance element passing through the geometric center point of the impedance element intersects the midpoint of the line segment passing through the geometric center points of an adjacent pair of impedance elements on said second surface of said dielectric sheet.

3. A sheet impedance device in accordance with claim 2 wherein the distance between the geometric center points of successive impedance elements on said first surface of said dielectric sheet along at least one direction within the plane of said dielectric sheet is constant.

4. A sheet impedance device in accordance with claim 1 further comprising:

a spacing sheet comprised of dielectric material having a first and second surface, said first surface of said spacing sheet being disposed over said impedance elements on said second surface of said dielectric sheet; and a layer of electrically resistive material disposed on said second surface of said spacing sheet.

5. A sheet impedance device comprising:

a dielectric sheet, having a first surface and a second surface opposite said first surface;

a first array of spatially separated, substantially planar impedance elements comprised of conductive or resistive materials disposed on said first surface of said dielectric sheet; and a second array of spatially separated, substantially planar impedance elements disposed on said second surface of said dielectric sheet;

whereby impedance elements are provided on both sides of said dielectric sheet and wherein said impedance elements have a dimension which varies incrementally with respect to the location of the impedance element along at least one direction within the plane of said dielectric sheet.

6. A sheet impedance device comprising:

a dielectric sheet, having a first surface and a second surface opposite said first surface;

a first array of spatially separated, substantially planar impedance elements comprised of conductive or resistive materials disposed on said first surface of said dielectric sheet; and a second array of spatially separated, substantially planar impedance elements disposed on said second surface of said dielectric sheet;

whereby impedance elements are provided on both sides of said dielectric sheet and wherein the distance between said impedance elements varies incrementally with respect to the location of the impedance elements along at least one direction within the plane of said dielectric sheet.

7. A sheet impedance device comprising:

a dielectric sheet, having a first surface and a second surface opposite said first surface;

a first array of spatially separated, substantially planar impedance elements comprised of conductive or resistive materials disposed on said first surface of said dielectric sheet; and a second array of spatially separated, substantially planar impedance elements disposed on said second surface of said dielectric sheet;

whereby impedance elements are provided on both sides of said dielectric sheet and positioned such that for each impedance element on said first surface of said dielectric sheet, the offset distance between a line perpendicular to the plane of the impedance element passing through the geometric center point of the impedance element and the geometric center point of the most proximate impedance element disposed on said second surface of said dielectric sheet varies incrementally with respect to the location of the impedance element along at least one direction within the plane of said dielectric sheet.

8. A sheet impedance device comprising:

a dielectric sheet, having a first surface and a second surface opposite said first surface;

an array of spatially separated, substantially planar impedance elements comprised of conductive or resistive materials disposed on said first surface of said dielectric sheet; and a layer of electrically resistive material disposed on said second surface of said dielectric sheet.

9. A method for providing impedance in a substantially planar apparatus comprising a dielectric sheet having a first surface and a second surface opposite said first surface, said method comprising the steps of:

disposing an array of spatially separated, substantially planar impedance elements comprised of conductive or resistive materials on said first surface of said dielectric sheet; and disposing an array of substantially planar impedance elements on said second surface of said dielectric sheet, such that for each impedance element on said first surface of said dielectric sheet, the distance between a line perpendicular to the plane of the impedance element passing through the geometric center point of the impedance element and the geometric center point of the most proximate impedance element disposed on said second surface of said dielectric sheet is greater than zero.

10. Apparatus for selectively absorbing electromagnetic energy waves incident thereupon, said waves emanating from a source, and said apparatus comprising:

an electrically conductive reflector means;

a plurality of impedance sheet devices positioned between the reflector means and the source, each impedance sheet device comprised of a dielectric sheet, said dielectric sheet having a first surface and a second surface opposite said first surface, an array of spatially separated, substantially planar impedance elements comprised of conductive or resistive materials disposed on said first surface of said dielectric sheet, and an array of substantially planar impedance elements disposed on said second surface of said dielectric sheet; and means for supporting each said impedance sheet device at a distance from said reflector means such that attenuation of incident electromagnetic radiation within a desired frequency range results.

* * * * *